US007744357B2

(12) United States Patent
Kim et al.

(10) Patent No.: US 7,744,357 B2
(45) Date of Patent: Jun. 29, 2010

(54) SCROLL COMPRESSOR

(75) Inventors: Seung Yup Kim, Suwon-si (KR); Myung Kyun Kim, Bucheon-si (KR); Byung Kil Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 808 days.

(21) Appl. No.: 11/609,482

(22) Filed: Dec. 12, 2006

(65) Prior Publication Data

US 2007/0140884 A1 Jun. 21, 2007

(30) Foreign Application Priority Data

Dec. 12, 2005 (KR) ..... 10-2005-0121486

(51) Int. Cl.
*F04C 18/00* (2006.01)
*F04C 2/00* (2006.01)

(52) U.S. Cl. ..... 418/55.6; 418/55.1; 418/94; 418/97; 418/DIG. 1

(58) Field of Classification Search ..... 418/91, 418/94, 97, 99, 55.1–55.6, 57, 270, DIG. 1
See application file for complete search history.

(56) References Cited

U.S. PATENT DOCUMENTS 6,896,493 B2 5/2005 Chang et al.

FOREIGN PATENT DOCUMENTS

| | | | | |
|---|---|---|---|---|
| JP | 61178590 | A | * | 8/1986 |
| JP | 62126282 | A | * | 6/1987 |
| JP | 63131888 | A | * | 6/1988 |
| JP | 63150489 | A | * | 6/1988 |
| JP | 05052193 | A | * | 3/1993 |
| JP | 2000080990 | A | * | 3/2000 |

OTHER PUBLICATIONS

U.S. Appl. No. 11/422,149 to Kim et al., filed Jun. 5, 2006.

* cited by examiner

*Primary Examiner*—Theresa Trieu
(74) *Attorney, Agent, or Firm*—McKenna Long & Aldridge LLP

(57) ABSTRACT

A scroll compressor includes a fixed scroll, an orbiting scroll orbiting the fixed scroll to perform compression on a refrigerant, a discharge cover provided at an upper end of the fixed scroll and guiding discharge of a compressed refrigerant, a first discharge chamber from which the compressed refrigerant is discharged; a second discharge chamber communicating with the first discharge chamber and separating oil from the discharged refrigerant, and a third discharge chamber communicating with the second discharge chamber and guiding discharge of the separated refrigerant.

19 Claims, 5 Drawing Sheets

SCROLL COMPRESSOR

CROSS-REFERENCE TO RELATED APPLICATIONS

The present disclosure relates to subject matter contained in priority Korean Application No. 10-2005-0121486, filed on Dec. 12, 2005, which is herein expressly incorporated by reference in its entirety.

BACKGROUND OF THE INVENTION

1. Field of the Invention

The present invention relates to a scroll compressor, and more particularly, to a scroll compressor capable of reducing noise generated in a process of discharging oil and refrigerant compressed in a scroll compression unit and returning oil being discharged.

2. Description of the Related Art

In general, compressors serve to convert mechanical energy to a compressive force. Such compressors include the reciprocating type, the scroll type, the centrifugal type, and the vane type. Particularly, the scroll compressor is commonly used for air conditioners and refrigerators.

Further, scroll compressors may be categorized as a low-pressure type scroll compressor or a high-pressure type scroll compressor, according to whether an inflow gas or an outflow gas is filled in a casing.

The related art low pressure type scroll compressor includes a casing, an upper cover mounted to an upper side of the casing, a drive motor provided inside the casing and including a rotor and a stator, a drive shaft rotated by rotation of the drive motor, having an eccentric portion at its upper portion and having therein a fluid flow path, an upper frame inserted in an upper side of the drive shaft, and an intake pipe through which a fluid is introduced from the exterior.

Also, a scroll compression unit is provided, that includes an orbiting scroll placed on the upper frame and compressing a refrigerant forced thereinto through the intake pipe, and a fixed scroll interlocked with the orbiting scroll and fixed on the upper frame.

In addition, a discharge unit is provided, that includes a discharge port through which a refrigerant compressed in the fixed scroll is discharged, a discharge chamber formed between the fixed scroll and the upper cover, and a discharge pipe formed at one side of the upper cover.

The operation of the scroll compressor will now be briefly described.

First, when a low pressure refrigerant that has passed through an expansion process is introduced through the intake pipe, a portion of the introduced refrigerant flows to the scroll compression unit and the other portion thereof flows down and is stored in a lower side of the casing. The oil and high-pressure refrigerant compressed in the scroll compression unit are discharged to the discharge chamber through the discharge port. Then, the refrigerant and oil discharged to the discharge chamber are discharged out of the compressor through the discharge pipe.

The compressed refrigerant and oil are discharged at a very high rate, and such high discharge rate of the refrigerant and oil causes noise.

Additionally, more noise is produced due to direct collision between the refrigerant and oil and the upper cover, which occurs when the refrigerant and oil compressed in the scroll compression unit are discharged through the discharge port.

Also, a shortage of oil to lubricate the scroll compression unit within the scroll compressor occurs because the refrigerant and oil that have passed through the discharge port are discharged through the discharge pipe.

SUMMARY OF THE INVENTION

The present invention is directed to a scroll compressor that addresses one or more problems due to limitations and disadvantages of the related art.

An object of the present invention is to provide a scroll compressor capable of reducing noise generated in a process of discharging compressed refrigerant and oil by improving the discharge unit.

Another object of the present invention is to provide a scroll compressor capable of separating oil from a refrigerant being discharged through a discharge unit and of allowing return of the separated oil.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

An aspect of the present invention provides a scroll compressor, including a fixed scroll; an orbiting scroll configured to orbit the fixed scroll to perform compression on a refrigerant; a discharge cover provided at an upper end of the fixed scroll and guiding discharge of a compressed refrigerant; a first discharge chamber from which the compressed refrigerant is discharged; a second discharge chamber communicating with the first discharge chamber and separating oil from the discharged refrigerant; and a third discharge chamber communicating with the second discharge chamber and guiding discharge of the separated refrigerant. Further, the first discharge chamber is formed at a central portion of the fixed scroll; and the second discharge chamber is formed between the fixed scroll and the discharge cover. The third discharge chamber includes an internal space of a molded portion extending downwardly from a lower surface of the discharge cover. The third discharge chamber is formed inside the second discharge chamber. Additionally, the discharge cover may include a discharge guiding portion guiding discharge of a compressed refrigerant and oil; and an engagement portion extending from a lower end of the discharge guiding portion and coupled to the fixed scroll. The fixed scroll may include an oil return path through which separated oil returns; and an oil return portion communicating with the oil return path and guiding flow of the returning oil.

In a further aspect of the present invention, the oil return path includes an inlet formed at an upper surface of the fixed scroll, and an outlet formed at a side surface of the fixed scroll. The oil return path includes a capillary pipe facilitating return of oil. Further, the oil return portion may include a coupling member coupled to the fixed scroll; and an oil return pipe having a predetermined length, coupled to the coupling member and communicating with the oil return path. The oil return pipe may include a capillary pipe. The discharge chambers may have different cross-sectional areas.

A further aspect of the present invention provides a scroll compressor, including a scroll compression unit including a fixed scroll and an orbiting scroll configured to orbit the fixed scroll and performing compression on a fluid; a discharge cover provided at an upper end of the scroll compression unit and serving to reduce noise generated when a compressed fluid is discharged; a plurality of discharge chambers guiding discharge of a fluid compressed in the scroll compression unit; and an oil return path through which oil separated from a fluid returns while the fluid is flowing inside the plurality of discharge chambers. Further, the plurality of discharge chambers may include a first discharge chamber formed at the fixed scroll; a second discharge chamber formed between the fixed scroll and the discharge cover; and a third discharge chamber formed inside the second discharge chamber. The third discharge chamber may include an internal space of an extending part extending downwardly from a lower surface of the discharge cover. The plurality of chambers may have different cross-sectional areas. The oil return path may be formed at the fixed scroll and has an end portion coupled to an oil return portion guiding a flow of returning oil. Further, the fixed scroll may include a coupling end coupled to the oil return portion, and the oil return portion may include a coupling member coupled to the coupling end. The oil return path may include a capillary pipe therein.

A further aspect of the present invention provides a scroll compressor, including a casing; a division member dividing the inside of the casing into a low-pressure portion and a high-pressure portion; a fixed scroll coupled to a lower side of the division member; an orbiting scroll configured to orbit the fixed scroll and performing compression on a fluid; a first discharge chamber formed at the fixed scroll and from which a compressed refrigerant is discharged; a second discharge chamber formed between the fixed scroll and the division member and separating oil from the discharge refrigerant; and a third discharge chamber communicating with the second discharge chamber and from which the separated refrigerant is discharged.

It is to be understood that both the foregoing general description and the following detailed description of the present invention are exemplary and explanatory and are intended to provide further explanation of the invention as claimed.

BRIEF DESCRIPTION OF THE DRAWINGS

The above, and other objects, features, and advantages of the present invention will be made apparent from the following description of the preferred embodiments, given as non-limiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The embodiments of the present invention are described with reference to the drawings. Wherever possible, the same reference numbers will be used throughout the drawings to refer to the same or like parts.

Figure 1:
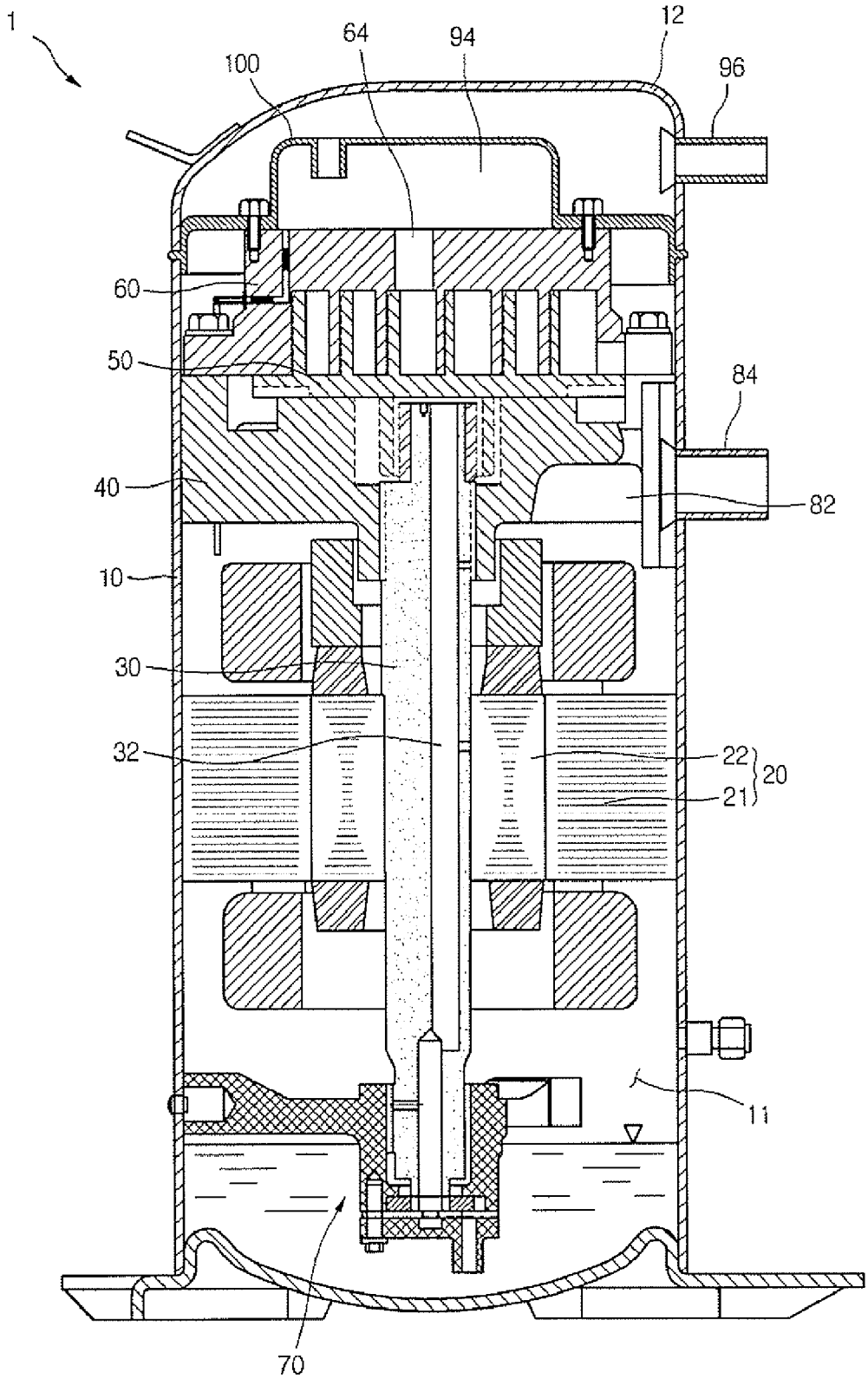
FIG. 1 is a cross-sectional view of a scroll compressor according to the present invention.

FIG. 1 is a cross-sectional view of a scroll compressor according to the present invention.

Referring to FIG. 1, a scroll compressor 1 according to the present invention includes an exterior portion formed by a casing 10, and a cover member 12 mounted on an upper end of the casing 10.

The scroll compressor 1 includes a drive unit generating a rotary force, an intake unit forcing a fluid into the compressor from the outside of the casing 10, a scroll compression unit compressing a fluid introduced from the intake unit, a discharge unit discharging a high pressure fluid compressed in the scroll compression unit, and an oil pump 70 supplying oil to a portion to be lubricated such as the scroll compression unit.

In detail, the drive unit includes a drive motor 20 having a stator 21 fixed to the interior of the casing 10 and a rotor 22 positioned inside the stator 21, and a drive shaft 30 that is a rotary shaft inserted in a central portion of the drive motor 20.

A fluid flow path 32 is formed at the drive shaft 30, through which oil pumped by the oil pump 70 flows upward.

Further, the intake unit includes an intake pipe 84 formed at one side of an outer circumferential surface of the casing 10, and an intake chamber 82 communicating with the intake pipe 84 and in which an introduced refrigerant is accumulated.

The scroll compression unit includes an upper frame 40 fit to an upper portion of the drive shaft 30 and supporting the drive shaft 30, an orbiting scroll 50 provided on the upper frame 40 and compressing a refrigerant forced therein through the intake pipe 84, and a fixed scroll 60 interlocked with the orbiting scroll 50 and fixed on the upper frame 40.

In addition, the discharge unit includes a discharge port 64 formed at a central portion of the fixed scroll 60 and through which compressed refrigerant and oil are discharged, a discharge chamber 94 formed between the fixed scroll 60 and a discharge cover 100 mounted onto the fixed scroll 60, and a discharge pipe 96 formed at one side of the cover member 12.

The discharge cover 100 divides the inside of the scroll compressor into a lower low-pressure portion and an upper high-pressure portion.

The oil pump 70 is provided at a lower end in the casing 10 and is connected to the drive shaft 30. The oil pump 70 is operated by the rotation of the drive shaft 30 to thereby pump the oil up from an oil storage 11 positioned at an end of the casing 10.

The operation of the scroll compressor 1 will now be described.

First, when the scroll compressor 1 is driven, a refrigerant is forced into the compressor through the intake pipe 84. Then, a portion of the introduced refrigerant flows into the scroll compression unit via the intake chamber 82, and the other portion thereof flows to and is stored in the oil storage 11.

The refrigerant flowing into the scroll compression unit is compressed to have a high pressure by an orbiting motion of the orbiting scroll 50, and the compressed refrigerant collectively flows to a central portion of the scroll compression unit. The high-pressure refrigerant collected in the central portion is discharged to the discharge chamber 94 through the discharge port 64. Finally, the refrigerant accumulated in the discharge chamber 94 is discharged to the exterior of the scroll compressor 1 through the discharge pipe 96.

While the refrigerant is being compressed in the above described manner, the oil pump 70 pumps the oil up from the oil storage 11. Accordingly, the oil flows up along the inside of the drive shaft 30 due to the pumping of the oil pump 70 and lubricates the drive shaft 30.

Figure 2:
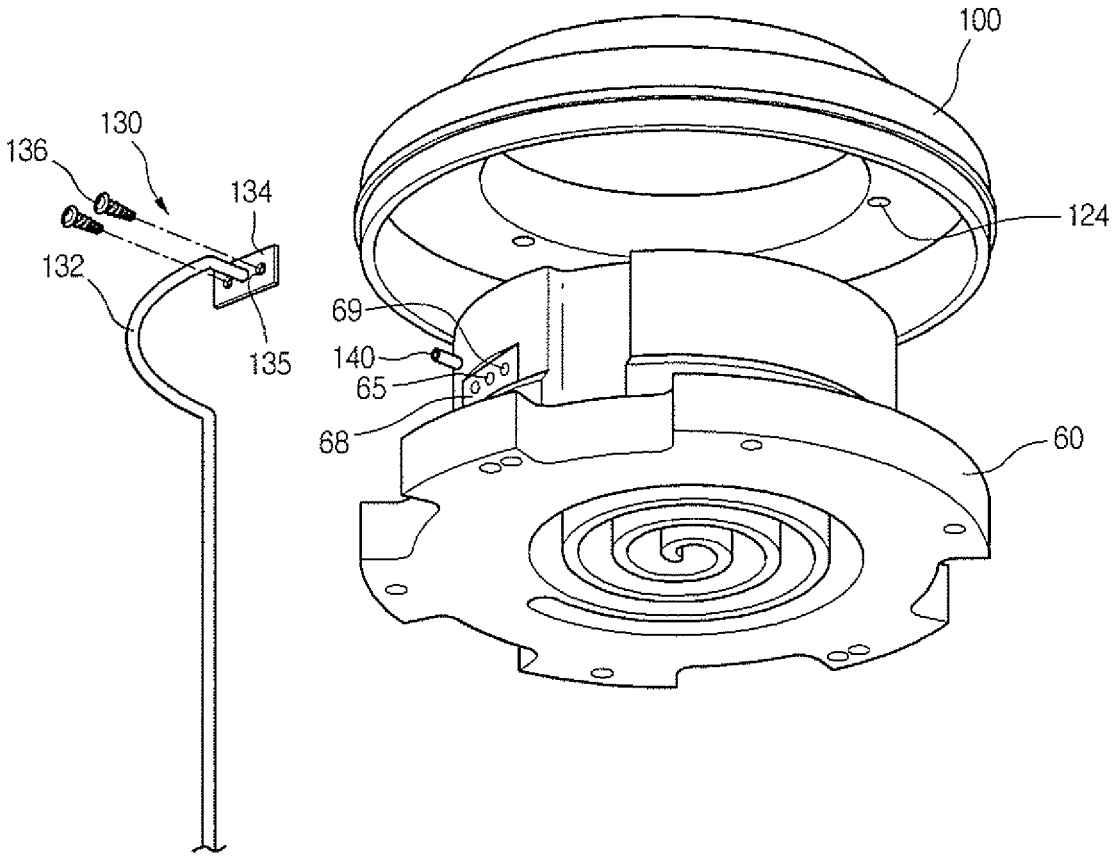
FIG. 2 is an exploded perspective view illustrating coupling of a discharge cover and a fixed scroll in the scroll compressor of FIG. 1.
Figure 3:
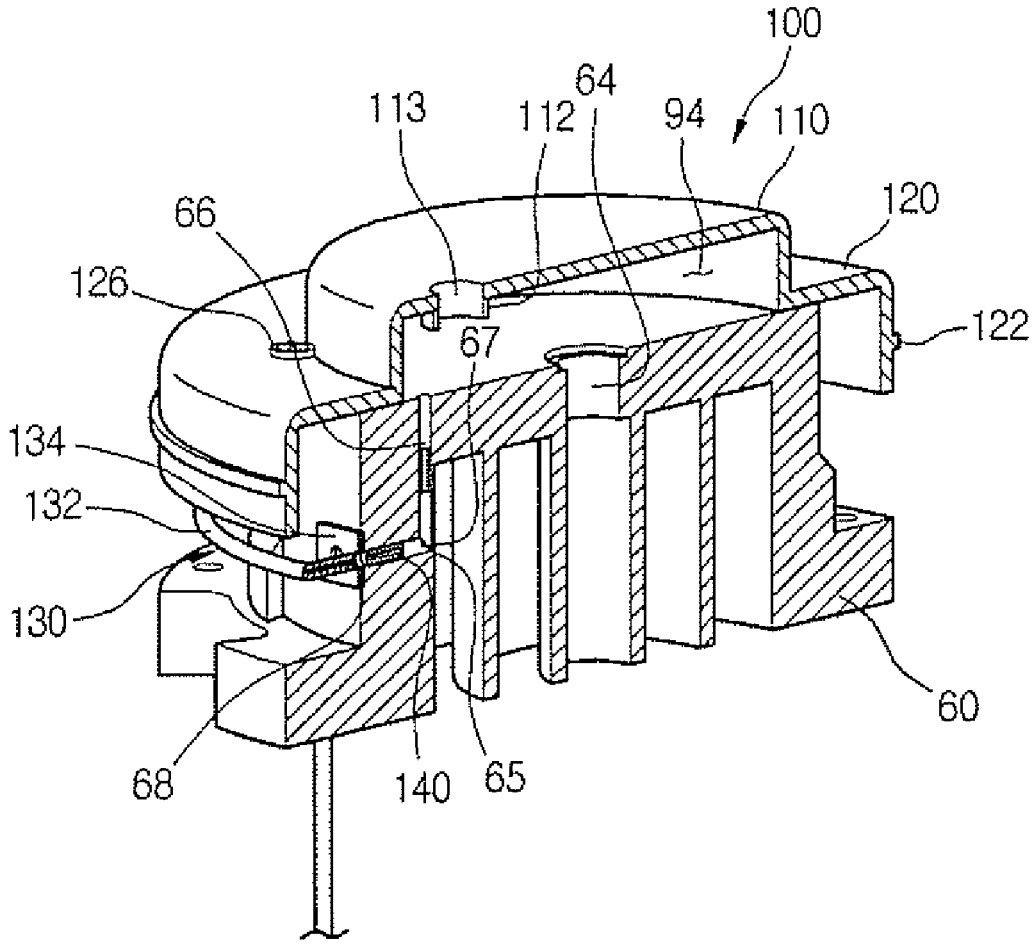
FIG. 3 is a perspective cross-sectional view illustrating a coupling relationship between a discharge cover and a fixed scroll in the scroll compressor of FIG. 1.

FIG. 2 is an exploded perspective view showing the coupling between the discharge cover 100 and the fixed scroll 60 according to the present invention. FIG. 3 is a cross-sectional perspective view showing the coupling relationship between the discharge cover 100 and the fixed scroll 60.

Referring to FIGS. 2 and 3, the discharge cover 100 is mounted onto the fixed scroll 60 and reduces noise generated in the process of discharging the compressed refrigerant and oil.

More particularly in detail, the discharge cover 100 includes a discharge guiding portion 110 formed in a stepped configuration and guiding a discharge of a refrigerant and oil, and an engagement portion 120. In the present embodiment, the engagement portion 120 extends from a lower end of the discharge guiding portion 110 and engages the fixed scroll 60. Further, in the present embodiment, the engagement portion 120 is molded and is formed unitarily and in one piece with the discharge guiding portion 110.

The discharge guiding portion 110 includes a separation portion 112 molded and extending downwardly from a lower surface of the discharge guiding portion 110. The separation portion 112 guides discharge of a refrigerant and simultaneously separates oil from the refrigerant. The separation portion 112 has a cylindrical shape and includes therein a discharge path 113 through which a refrigerant is discharged.

The engagement portion 120 includes a plurality of engagement holes 124 arranged circumferentially on the engagement portion 120 and engaged with coupling members 126 so as to be coupled to the fixed scroll 60. A support rib 122 supporting the cover member 12 and the casing 10 is formed around an outer circumferential surface of the engagement portion 120. Accordingly, the cover member 12 is supported by an upper side of the support rib 122, and the casing 10 is supported by a lower side of the support rib 122.

The fixed scroll 60 includes an oil return path 65 through which the separated oil returns. An oil return portion 130 is coupled to the oil return path 65.

More particularly, the oil return path 65 includes a vertical path 66 extending downwardly from an upper surface of the fixed scroll 60, and a horizontal path 67 extending horizontally from an end of the vertical path 66.

A capillary pipe 140 facilitating the return of oil is inserted in the horizontal path 67 and/or the vertical path 66.

The fixed scroll 60 includes at a side thereof, a coupling end 68 coupled to the oil return portion 130.

The oil return portion 130 includes a coupling member 134 coupled to the coupling end 68 and an oil return pipe 132 guiding the oil to return to the oil storage 11.

Further, the coupling member 134 has a shape corresponding to the coupling end 68. The coupling member 134 includes a plurality of engagement holes 135 engaged with coupling members 136, and the coupling end 68 includes engagement threads 69 at positions corresponding to those of the engagement holes 135.

The oil return pipe 132 communicates with the oil return path 65 when the coupling member 134 is coupled to the coupling end 68, and has a diameter substantially equal to that of the oil return path 65. The oil return pipe 132 extends downwardly a predetermined distance to a predetermined length, and guides oil having entered therein from the oil return path 65 to flow to the oil storage 11.

The oil return pipe 132 may be formed as a capillary pipe in order to allow smooth return of the oil due to capillary action.

When the discharge cover 100 is coupled to the fixed scroll 60, a plurality of discharge chambers to which a compressed refrigerant and oil are discharged are formed, thereby reducing noise generated during the process of discharging the refrigerant and oil.

More particularly, the discharge port 64 formed at an upper central portion of the fixed scroll 60 forms a first discharge chamber, the discharge chamber 94 formed between the fixed scroll 60 and the discharge guiding portion 110 forms a second discharge chamber, and the discharge path 113 formed in the separation portion 112 forms a third discharge chamber. The discharge chambers may have different cross-sectional areas.

A relationship between noise and the number of discharge chambers is as follows:

$$\begin{Bmatrix} P_o(\omega) \\ Q_o(\omega) \end{Bmatrix} = \underbrace{\begin{bmatrix} \cos kL & j\frac{\rho c}{S}\sin kL \\ j\frac{S}{\rho c}\sin kL & \cos kL \end{bmatrix}}_{T} \begin{Bmatrix} P_i(\omega) \\ Q_i(\omega) \end{Bmatrix} \quad \text{Equation 1}$$

$$\begin{Bmatrix} P_o(\omega) \\ Q_o(\omega) \end{Bmatrix} = \underbrace{\begin{bmatrix} \cos kL_1 & j\frac{\rho c}{S_1}\sin kL_1 \\ j\frac{S_1}{\rho c}\sin kL_1 & \cos kL_1 \end{bmatrix}\begin{bmatrix} \cos kL_2 & j\frac{\rho c}{S_2}\sin kL_2 \\ j\frac{S_2}{\rho c}\sin kL_2 & \cos kL_2 \end{bmatrix}\begin{bmatrix} \cos kL_3 & j\frac{\rho c}{S_3}\sin kL_3 \\ j\frac{S_3}{\rho c}\sin kL_3 & \cos kL_3 \end{bmatrix}}_{T} \begin{Bmatrix} P_i(\omega) \\ Q_i(\omega) \end{Bmatrix} \quad \text{Equation 2}$$

Here, the equation 1 determines the transfer function T when there is one discharge chamber, and the equation 2 determines the transfer function T when there are three chambers. In general, as the matrix determinant of the transfer function T is smaller, less noise is generated.

P, Q and S represent sound pressure, volume speed, and cross sectional area of a discharge chamber, respectively. Also, L, c and k represent length of the discharge chamber, speed of sound, and the wave number, respectively. Suffixes 1, 2 and 3 represent discharge chambers, respectively.

To compare the matrix determinants according to the above equations, the matrix determinant of the transfer function T by the equation 2 is smaller than that by the equation 1.

Namely, the discharge rate of the refrigerant and oil decreases (e.g., the discharge thereof slows down) as the refrigerant and oil pass through the plurality of discharge chambers. For this reason, the matrix determinant of Equation 2 is smaller than the matrix determinant of Equation 1. Thus, such a decrease in the discharge rate contributes to reducing noise.

The process of discharging the compressed refrigerant oil will now be described.

Figure 4:
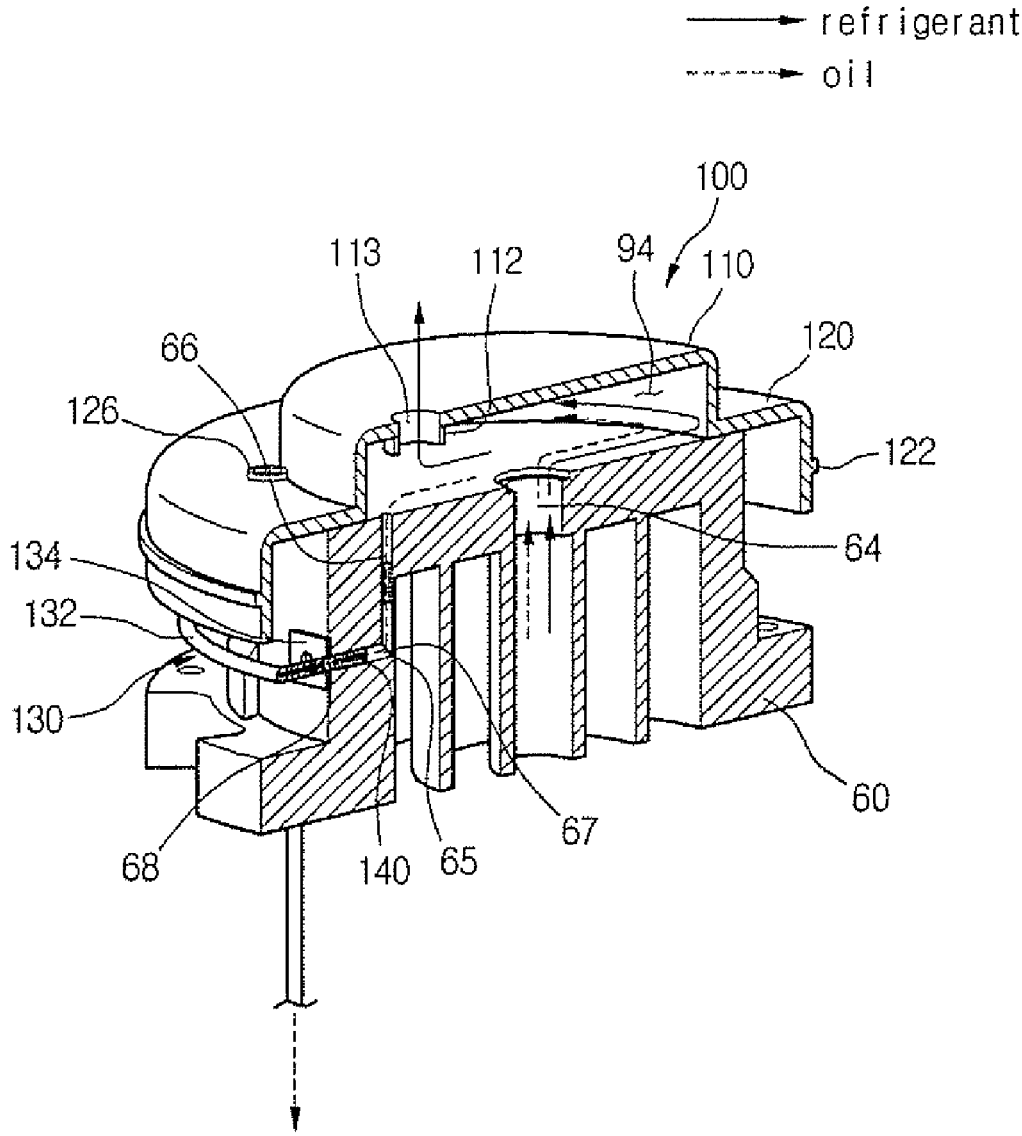
FIG. 4 is a perspective cross-sectional view illustrating a process of discharging a refrigerant and oil compressed in a scroll compression unit in the scroll compressor of FIG. 1.

FIG. 4 is a view illustrating a discharge process of a compressed refrigerant oil in the scroll compression unit according to the present invention. In the drawing, the solid line depicts refrigerant flow, and the dotted line depicts oil flow.

Referring to FIG. 4, oil and refrigerant compressed in the scroll compression unit are discharged to the discharge chamber 94 (ie., the second discharge chamber), through the discharge port 64 (ie., the first discharge chamber). The refrigerant and oil do not directly collide with the upper cover 12 but collide first with the discharge guiding portion 110. Thus, noise that can be heard from the exterior of the scroll compressor 1 is substantially reduced.

The refrigerant and oil collide with the discharge guiding portion 110 and are separated from each other while flowing inside the second discharge chamber.

The refrigerant that has been separated within the second discharge chamber is discharged to the discharge path 113 (i.e., the third discharge chamber), and then discharged to the exterior of the scroll compressor 1 along the discharge pipe 96.

In contrast, the separated oil flows into the oil return path 65. Then, the oil that has flowed into the oil return path 65 flows into the oil return pipe 132 via the capillary pipe 140. The oil that has flowed into the oil return pipe 132 flows down to be finally stored in the oil storage 11.

As described above, the refrigerant is discharged sequentially through the first discharge chamber, the second discharge chamber, and the third discharge chamber. As the refrigerant passes through each of the discharge chambers, the discharge rate thereof decreases.

Figure 5:
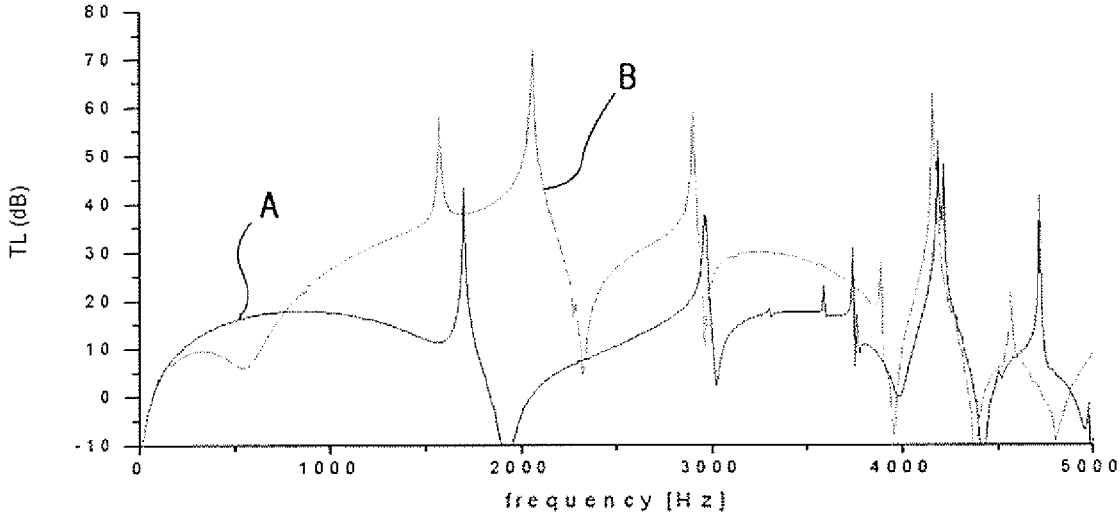
FIG. 5 is a graph showing the relationship between noise and the number of discharge chambers, which is interpreted by SYSNOISE, in the scroll compressor of FIG. 1.

FIG. 5 is a graph showing a relation between noise and the number of discharge chambers, interpreted by SYSNOISE.

The frequency is shown on the x-axis and the transmission loss (TL) is shown on the y-axis. Line A shows the result in which there is one discharge chamber, and line B shows a result in which there are three discharge chambers. In general, less noise is generated as the transmission loss (TL) value is greater.

Referring to FIG. 5, to compare the two lines A and B under conditions that the frequency is within the range of 1~3 KHz bandwidth, it can be seen that the transmission loss (TL) value in the case of three discharge chambers (line B) is greater than that in the case of one discharge chamber (line A) by approximately 10~30 db.

In other words, less noise is generated when there are three discharge chambers, as compared to noise generation when there is one discharge chamber.

Although three discharge chambers are provided in the present embodiment, the scope of the present invention is not limited to the number of discharge chambers. Accordingly, the scroll compressor of the present invention may include any suitable number of discharge chambers.

As described so far, in the present invention, coupling of the discharge cover to the fixed scroll allows refrigerant and oil discharged from the discharge port to collide with the discharge cover, thereby reducing noise due to impact of the refrigerant and oil with surfaces of the device.

Also, in the present invention, a plurality of discharge chambers are provided due to the coupling of the discharge cover to the fixed scroll. As compressed refrigerant and oil passes through each of the discharge chambers, the discharge rate thereof decreases (the discharge thereof slows down), which contributes to minimizing noise generation caused by the high discharge rate.

Also, in the present invention, refrigerant and oil being discharged collide with the discharge cover and are separated from each other while flowing inside the discharge cover. Accordingly, the performance of separating the refrigerant and oil is improved.

In addition, in the present invention, the fixed scroll includes the oil return path, and the oil return path includes the oil return pipe, so that the separated oil can return to and be stored in the oil storage.

It will be apparent to those skilled in the art that various modifications and variations can be made in the present invention. Thus, it is intended that the present invention covers the modifications and variations of this invention provided they come within the scope of the appended claims and their equivalents.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A scroll compressor, comprising:

a fixed scroll;

an orbiting scroll configured to orbit the fixed scroll to perform compression on a refrigerant;

a discharge cover provided at an upper end of the fixed scroll and guiding discharge of a compressed refrigerant;

a cover member that covers the discharge cover and includes a discharge pipe to discharge the compressed refrigerant to outside;

a first discharge chamber from which the compressed refrigerant is discharged;

a second discharge chamber communicating with the first discharge chamber and separating oil from the discharged refrigerant;

a third discharge chamber communicating with the second discharge chamber and guiding discharge of the separated refrigerant, and a discharge passage provided between the cover member and the discharge cover and that communicates with the third chamber and the discharge pipe, wherein the discharge cover includes an extending portion spaced apart from the discharge pipe and extended toward the fixed scroll and the extending portion defines the third discharge chamber.

2. The scroll compressor according to claim 1, wherein the first discharge chamber is formed at a central portion of the fixed scroll.

3. The scroll compressor according to claim 1, wherein the second discharge chamber is formed between the fixed scroll and the discharge cover.

4. The scroll compressor according to claim 1, wherein the extending portion extends downwardly from a lower surface of the discharge cover.

5. The scroll compressor according to claim 1, wherein the third discharge chamber is formed inside the second discharge chamber.

6. The scroll compressor according to claim 1, wherein the discharge cover comprises:

a discharge guiding portion guiding discharge of a compressed refrigerant and oil; and an engagement portion extending from a lower end of the discharge guiding portion and coupled to the fixed scroll.

7. The scroll compressor according to claim 1, wherein the fixed scroll comprises:

an oil return path through which separated oil returns; and an oil return portion communicating with the oil return path and guiding flow of the returning oil.

8. The scroll compressor according to claim 7, wherein the oil return path includes an inlet formed at an upper surface of the fixed scroll, and an outlet formed at a side surface of the fixed scroll.

9. The scroll compressor according to claim 7, wherein the oil return path comprises a capillary pipe facilitating return of oil.

10. The scroll compressor according to claim 7, wherein the oil return portion comprises:

a coupling member coupled to a side surface of the fixed scroll; and an oil return pipe having a predetermined length, coupled to the coupling member and communicating with the oil return path, wherein the oil return pipe extends downwardly.

11. The scroll compressor according to claim 10, wherein the oil return pipe comprises a capillary pipe, the capillary pipe is provided inside of the oil return pipe.

12. The scroll compressor according to claim 1, wherein the discharge chambers have different cross-sectional areas.

13. A scroll compressor, comprising:

a scroll compression unit including a fixed scroll and an orbiting scroll configured to orbit the fixed scroll and performing compression on a fluid;

a discharge cover provided at an upper end of the scroll compression unit and serving to reduce noise generated when a compressed fluid is discharged;

a plurality of discharge chambers guiding discharge of a fluid compressed in the scroll compression unit;

an oil return path formed in the fixed scroll through which oil separated from a fluid returns while the fluid is flowing inside the plurality of discharge chambers;

an oil return pipe communicated with the oil return path; and a coupling member coupled to a side surface of the fixed scroll and connecting the oil return pipe and the fixed scroll, wherein the oil return pipe is provided outside of the fixed scroll and extended downwardly.

14. The scroll compressor according to claim 13, wherein the plurality of discharge chambers comprise:

a first discharge chamber formed at the fixed scroll;

a second discharge chamber formed between the fixed scroll and the discharge cover; and a third discharge chamber formed inside the second discharge chamber.

15. The scroll compressor according to claim 14, wherein an extending part is extended downwardly from a lower surface of the discharge cover, the extending part defines the third chamber.

16. The scroll compressor according to claim 14, further comprising that covers the discharge cover and including a discharge pipe to discharge the compressed fluid to outside and a discharge passage provided between the cover member and the discharge cover and that communicating the third chamber and the discharge pipe.

17. The scroll compressor according to claim 13, wherein the plurality of chambers have different cross-sectional areas.

18. The scroll compressor according to claim 13, wherein the oil return path includes a capillary pipe therein.

19. A scroll compressor, comprising:

a casing;

a cover member having a discharge pipe and coupled to the casing;

a division member dividing the inside of the casing and the cover member into a low-pressure portion and a high-pressure portion;

a fixed scroll coupled to a lower side of the division member;

an orbiting scroll configured to orbit the fixed scroll and performing compression on a fluid;

a first discharge chamber formed at the fixed scroll and from which a compressed refrigerant is discharged;

a second discharge chamber formed between the fixed scroll and the division member and separating oil from the discharge refrigerant; and a third discharge chamber communicating with the second discharge chamber and from which the separated refrigerant is discharged, wherein the division member includes a separation portion extended towards the fixed scroll from the division member, the separation portion defines the third chamber therein and is spaced apart from the discharge pipe, the division member and the cover member defines at least a portion of the high pressure portion.

* * * * *